US008991615B2

(12) United States Patent
Diez et al.

(10) Patent No.: US 8,991,615 B2
(45) Date of Patent: Mar. 31, 2015

(54) METHOD FOR OBTAINING NON-MAGNETIC ORES FROM A SUSPENSION-LIKE MASS FLOW CONTAINING NON-MAGNETIC ORE PARTICLES

(75) Inventors: Michael Diez, Erlangen (DE); Argun Gökpekin, Hammelburg (DE); Wolfgang Krieglstein, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/128,749

(22) PCT Filed: May 31, 2012

(86) PCT No.: PCT/EP2012/060218

§ 371 (c)(1),
(2), (4) Date: Dec. 23, 2013

(87) PCT Pub. No.: WO2012/175303

PCT Pub. Date: Dec. 27, 2012

(65) Prior Publication Data

US 2014/0124414 A1 May 8, 2014

(30) Foreign Application Priority Data

Jun. 21, 2011 (EP) ..... 11170703

(51) Int. Cl.
*B07C 5/00* (2006.01)
*B03C 1/015* (2006.01)

(52) U.S. Cl.
CPC ..... *B03C 1/015* (2013.01)
USPC ..... 209/552; 209/3; 209/5; 209/8; 209/39; 209/45; 209/66; 209/214; 209/215; 209/232; 209/12.1; 209/174; 209/175; 210/222

(58) Field of Classification Search
USPC ..... 209/3, 5, 8, 39, 45, 66, 214, 215, 232, 209/12.1, 174, 175, 552
See application file for complete search history.

(56) References Cited

U.S. PATENT DOCUMENTS 4,206,878 A * 6/1980 Forciea ..... 241/20

(Continued)

FOREIGN PATENT DOCUMENTS

EP 2090367 8/2009
EP 11170703 6/2011

(Continued)

OTHER PUBLICATIONS

European Office Action for European Priority Application No. 11170703.0, issued Nov. 24, 2011, 8 pages.

(Continued)

*Primary Examiner* — Prasad Gokhale
(74) *Attorney, Agent, or Firm* — Staas & Halsey LLP

(57) ABSTRACT

A method obtains non-magnetic ores from a suspension-like mass flow containing non-magnetic ore particles. The method involves mixing the mass flow with magnetic particles in a mixing device and forming ore particle-magnetic particle agglomerates, feeding the mass flow as a separator feed flow to a magnetic separator for separating the ore particle-magnetic particle agglomerates from the mass flow, forming a separator concentrate flow containing ore particle-magnetic particle agglomerates and a separator residual flow containing the remaining constituents of the mass flow, and separating the ore particles from the ore particle-magnetic particle agglomerates contained in the separator concentrate flow. At least one information indicating a measurement of the content of ore particles or magnetic particles in the separator feed flow and/or the separator concentrate flow and/or the separator residual flow is determined for determining an efficiency of at least one of the mixing apparatus and/or the magnetic separator.

19 Claims, 1 Drawing Sheet

(56) References Cited

U.S. PATENT DOCUMENTS

| | | | | |
|---|---|---|---|---|
| 4,643,822 | A | 2/1987 | Parsonage | |
| 4,666,591 | A * | 5/1987 | Imai et al. | 209/38 |
| 4,781,671 | A * | 11/1988 | Pober et al. | 494/31 |
| 4,889,538 | A * | 12/1989 | Mikhlin et al. | 44/564 |
| 5,887,728 | A * | 3/1999 | Muranaka et al. | 209/636 |
| 8,342,336 | B2 * | 1/2013 | Diez et al. | 209/8 |
| 2011/0163039 | A1 | 7/2011 | Danov et al. | |
| 2014/0144812 | A1 * | 5/2014 | Bland et al. | 209/3 |

FOREIGN PATENT DOCUMENTS

| | | |
|---|---|---|
| WO | 2009/101070 | 8/2009 |
| WO | 2010/031714 | 3/2010 |
| WO | PCT/EP2012/060218 | 5/2012 |

OTHER PUBLICATIONS

English language International Search Report for PCT/EP2012/060218, mailed Jul. 10, 2012, 3 pages.

* cited by examiner

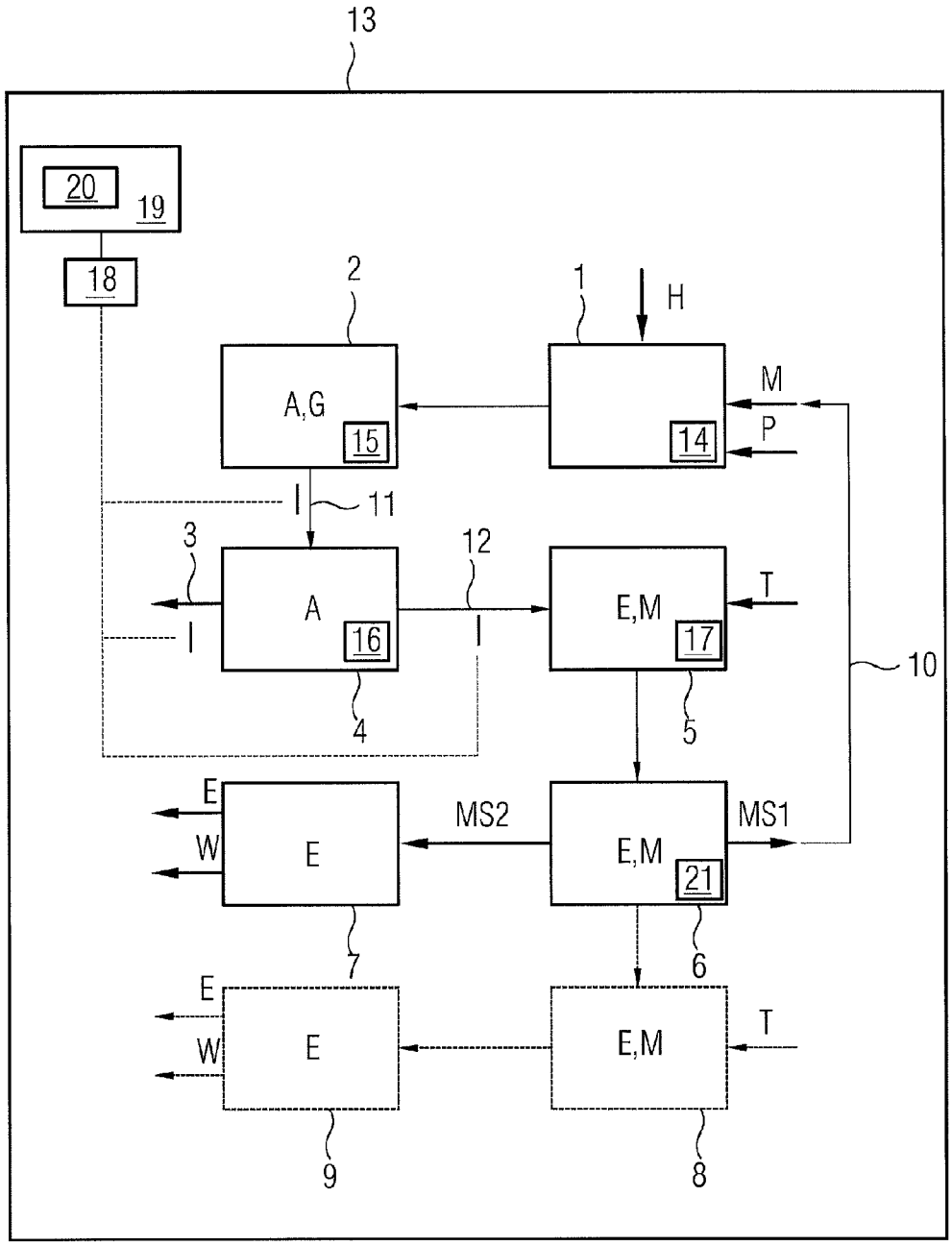
13
20
19
18
2
1
H
A,G
15
14
M
P
I
11
3
12
A
16
E,M
17
T
I
I
10
4
5
E
W
E
MS2
E,M
21
MS1
7
6
E
W
E
E,M
T
9
8

METHOD FOR OBTAINING NON-MAGNETIC ORES FROM A SUSPENSION-LIKE MASS FLOW CONTAINING NON-MAGNETIC ORE PARTICLES

CROSS REFERENCE TO RELATED APPLICATIONS

This application is based on and hereby claims priority to International Application No. PCT/EP2012/060218 filed on May 31, 2012 and European Application No. 11170703.0 filed on Jun. 21, 2011, the contents of which are hereby incorporated by reference.

BACKGROUND

The invention relates to a method for obtaining non-magnetic ores from a suspension-like mass flow containing non-magnetic ore particles.

The use of flotation cells for obtaining ores from ore-containing bulk material is well known. A mass flow in the form of an ore-containing pulp, i.e. substantially a suspension of water, ground rock (gangue) and ground ore is fed to a flotation cell or a flotation reactor.

In the context of "magnetic flotation" methods, the mass flow containing the pulp is loaded (in a "load process") with magnetic particles, which may be, for example, magnetic particles in the form of magnetite, to form ore particle-magnetic particle agglomerates. In order to form the ore particle-magnetic particle agglomerates, prior hydrophobization both of the ore particles and of the magnetic particles is usually required. The formation of the ore particle-magnetic particle agglomerates thus produced substantially by hydrophobic interactions or by attractive forces is achieved by mixing the starting materials in a mixing apparatus, taking account of particular mixing parameters such as shear forces, time, temperature, etc.

The mass flow containing the ore particle-magnetic particle agglomerates is then fed as a "separator feed flow" to a (first) separating device in the form of a magnetic separator. The magnetic separator serves to separate the ore particle-magnetic particle agglomerates from the mass flow or pulp, that is, the magnetic ore particle-magnetic particle agglomerates are extracted from the pulp and are transferred to a "separator concentrate flow" which substantially contains the ore particle-magnetic particle agglomerates, small quantities of gangue material and water. The remaining constituents or residues (known as "tailings") are fed to a separator residual flow.

Subsequently, the ore particle-magnetic particle agglomerates are split into the constituents thereof, specifically ore particles and magnetic particles, so that said materials are present together but unbound or separately in the form of a mixture (in an "unload process"). Typically, the separation of the ore particle-magnetic particle agglomerates is carried out by a further or second separating device with chemical processes by the use of suitable chemicals such as solvents or the like.

The separation of the magnetic particles which are present substantially in isolation, from the ore particles and the other constituents is also carried out subsequently in the context of the "unload" process using a further or third separating device, again typically in the form of, or comprising, a magnetic separator in which the magnetic particles are magnetically separated. Thereafter, separation takes place into a first mass flow containing magnetic particles and a second mass flow containing ore particles, which are present separately from one another and substantially or ideally contain only the respective pure material, that is, either pure magnetic particles or pure ore particles.

A method of this type is disclosed for example by EP 2 090 367 A1, which relates to a method for the continuous recovery of non-magnetic ores from a pulp containing non-magnetic ore particles. In said process, magnetic or magnetizable magnetic particles are fed to a pulp continuously flowing through a reactor, said magnetic particles forming ore-magnetic particle agglomerates with the non-magnetic ore particles. The ore-magnetic particle agglomerates are moved into an accumulator region of the reactor and then guided out of the accumulator region of the reactor by a magnetic field.

With the known method, it is often problematic for the separation of the relevant ore particle-magnetic particle agglomerates from the separator feed flow to be realized with sufficient efficiency. Separation of all the ore particle-magnetic particle agglomerates from the separator feed flow is usually not possible, that is, a certain residue of unremoved ore particle-magnetic particle agglomerates remains in the separator residual flow. This primarily arises firstly for statistical reasons, according to which a particular content of ore particle-magnetic particle agglomerates cannot be removed from the separator feed flow, and secondly due to the efficiency of the magnetic separator (first separating device) used for separating the ore particle-magnetic particle agglomerates from the separator feed flow.

Therefore, a certain amount of loss occurs in relation to the overall process, with regard to both the ore particles and the magnetic particles, because both the non-agglomerated ore particles and the magnetic particles as well as the ore particle-magnetic particle agglomerates not separated from the separator feed flow are not available for further use, or only with significant effort. No monitoring of the process for forming the ore particle-magnetic particle agglomerates, nor any monitoring of the process for separating out the ore particle-magnetic particle agglomerates from the separator feed flow take place.

SUMMARY

One potential object is therefore to provide an improved method for obtaining non-magnetic ores, particularly with regard to monitoring the process yield of the "load" process.

The inventors propose a method for obtaining non-magnetic ores from a suspension-like mass flow containing non-magnetic ore particles, comprising:

- mixing the mass flow with magnetic particles in at least one mixing apparatus and forming ore particle-magnetic particle agglomerates,
- feeding the mass flow as a separator feed flow to at least one magnetic separator for separating the ore particle-magnetic particle agglomerates from the separator feed flow,
- forming a separator concentrate flow containing ore particle-magnetic particle agglomerates and a separator residual flow containing the remaining constituents of the mass flow,
- separating the ore particles from the ore particle-magnetic particle agglomerates contained in the separator concentrate flow, which is characterized in that, in order to determine an efficiency of at least one process step, at least one item of information indicating a measure of the content of ore particles or magnetic particles in the separator feed flow and/or the separator concentrate flow and/or the separator residual flow is determined.

The method provides that the content of ore particles or magnetic particles or of ore particle-magnetic particle agglomerates is determined qualitatively or quantitatively. This is achieved based on the at least one item of information indicating a measure of the content of ore particles or magnetic particles in the separator feed flow and/or the separator concentrate flow and/or the separator residual flow.

The item of information permits conclusions to be drawn regarding the efficiency or process yield, particularly of the "load" process and possibly also regarding the processing steps of the method following the separation of the ore particle-magnetic particle agglomerates, in particular the separation of the ore particles from the ore particle-magnetic particle agglomerates.

The efficiency or yield of the processing step of formation of the ore particle-magnetic particle agglomerates and/or of the processing step of separation of the ore particle-magnetic particle agglomerates from the separator feed flow can therefore be described qualitatively or quantitatively for the first time. Therefore, direct or indirect information concerning the efficiency of the relevant processing steps can be obtained.

Determination of the at least one item of information indicating a measure of the content of ore particles or magnetic particles in the separator feed flow and/or the separator concentrate flow and/or the separator residual flow is preferably carried out by X-ray analysis methods, in particular X-ray fluorescence spectrometry (XRF) or X-ray diffraction (XRD) analysis. Naturally, other suitable methods for determining the item of information are also conceivable.

Magnetic particles in the context of this document are to be understood as being all magnetic or magnetizable particles. Ferrimagnetic particles such as magnetite ($Fe_3O_4$) are mentioned purely by way of example.

Ore particles in the context of this document are to be understood as being all non-magnetic, i.e. neither initially or in relation to the magnetic particles, only weakly magnetic nor magnetizable or in relation to the magnetic particles, only weakly magnetizable, ore particles. Copper ores such as chalcocite ($Cu_2S$) are mentioned purely by way of example.

The formation of ore particle-magnetic particle agglomerates in the context of the method involving at least one ore particle and at least one magnetic particle is carried out using at least one suitable mixing apparatus. The subsequent removal of the ore particle-magnetic particle agglomerates from the separator feed flow is carried out by a magnetic separator which optionally comprises a plurality of magnetic devices. The separation of the ore particles from the ore particle-magnetic particle agglomerates is carried out by suitable separating devices.

The separation of the ore particles from the removed ore particle-magnetic particle agglomerates provided according to the method can be carried out by feeding the ore particle-magnetic particle agglomerates to a separating device in which the ore particle-magnetic particle agglomerates are separated into a mixture of ore particles and magnetic particles which are present together but separately, and feeding the mixture to a separating device in which the magnetic particles are magnetically separated from the mixture by a magnetic device associated with the separating device, wherein a first mass flow containing magnetic particles and a second mass flow containing ore particles are formed.

Therefore, the magnetic separator for separating the ore particle-magnetic particle agglomerates from the separator feed flow can be designated the first separating device, the separating device for separating the ore particle-magnetic particle agglomerates separated from the separator concentrate flow into the mixture of ore particles and magnetic particles which are present together but separately can be designated the second separating device, and the separating device for separating the magnetic particles from the mixture can be designated the third separating device.

All the separating devices can have one or more separating areas, separating chambers, separating arrangements or the like associated therewith.

The determination of the item of information can take place, for example, after the separation of the ore particle-magnetic particle agglomerates from the residues remaining from the separator concentrate flow, that is, from the separator residual flow. In this way, a qualitative consideration of the process yield of the "load" process, in particular, is possible. Particular content levels of ore particles and/or of magnetic particles in the separator residual flow (tailings) indicate that the processing step for forming the ore particle-magnetic particle agglomerates should be optimized because a certain number of ore particles or magnetic particles that are unbound, that is, not agglomerated to ore particle-magnetic particle agglomerates, is still present in the residues.

In particular, information concerning the content of ore particles contained in the residues allows conclusions to be drawn at an early stage concerning the efficiency and/or yield of, in particular, the "load" process, i.e. substantially the content level of ore particles bound into the ore particle-magnetic particle agglomerates.

Particular content levels of ore particle-magnetic particle agglomerates in the separator residual flow, however, indicate that the processing step of separating the ore particle-magnetic particle agglomerates from the separator feed flow should be optimized.

Thus, based on the qualitative assessment of content levels of ore particles, magnetic particles or ore particle-magnetic particle agglomerates in the separator residual flow which possibly change over time, information concerning the process efficiency of, in particular, the "load" process is obtained in order possibly thus to carry out relevant measures, described in greater detail below, to increase the content level of ore particles bound into the ore particle-magnetic particle agglomerates, said content level being of relevance for the efficiency of the overall process.

Preferably at least one item of information indicating a measure of the content of ore particles and magnetic particles in the separator feed flow and/or the separator concentrate flow and/or the separator residual flow is determined. This means that it is possible to obtain information concerning both the content of ore particles and the content of magnetic particles in the respective flows, so that a comprehensive picture of the efficiency of the respective processing steps of the method can be provided, with regard to the content levels of both ore particles and of magnetic particles.

It is also conceivable that the item of information indicating a measure of the content of ore particles and/or magnetic particles is determined for at least two of the flows, wherein based on the information, particularly after a comparison of the items of information relating to the respective flows indicating the measure of the content of ore particles and/or magnetic particles, at least one operating parameter of the mixing apparatus and/or of the magnetic separator is set. Thus, for example, the content of ore particles and/or magnetic particles in the separator feed flow can be determined and compared with the corresponding content levels in the separator concentrate flow. Given an ideal binding of the ore particles to the magnetic particles, the separator concentrate flow does not contain any unbound, that is isolated, ore particles or magnetic particles. The same naturally applies for the separator residual flow.

Insofar as the information is determined for the separator feed flow and the separator residual flow, equally, based on the comparison of the separator feed flow-side item of information and the separator residual flow-side item of information, at least one operating parameter of the mixing device and/or of the magnetic separator can be set.

Suitably, the respective content levels of ore particles or of magnetic particles for all three flows, that is, the separator feed flow, the separator concentrate flow and the separator residual flow, are determined by corresponding items of information relating to the respective flows and compared with one another.

Substantially, high content levels of unbound ore particles or magnetic particles in the separator concentrate flow and the separator residual flow indicate an insufficient formation of corresponding ore particle-magnetic particle agglomerates, i.e. the process of mixing the ore particles contained in the original mass flow with the magnetic particles is to be improved. High content levels of ore particle-magnetic particle agglomerates in the separator residual flow also provide information on the process efficiency of, in particular, the method for forming or separating the ore particle-magnetic particle agglomerates.

Insofar as determination of the item of information for the original mass flow, i.e. the mass flow to be fed to the mixing apparatus, indicating a measure of the content of ore particles in the removed ore particle-magnetic particle agglomerates is also provided, from a comparison of the content of ore particles contained in the mass flow and of the content of ore particles contained in the separated ore particle-magnetic particle agglomerates, a quantitative determination of the content of ore particles in the separated ore particle-magnetic particle agglomerates can be made. Herein, the content of ore particles in the mass flow is already known before the formation of the ore particle-magnetic particle agglomerates, so that the efficiency of the "load" process is found from the difference between the output content of ore particles in the mass flow and the content of ore particles in the separator concentrate flow containing the separated ore particle-magnetic particle agglomerates. A suitable observation also applies for the usually known content of magnetic particles added.

Naturally, the content of ore particles and/or magnetic particles in the mass flow can also be compared with the corresponding content levels of ore particles or magnetic particles in the separator feed flow, which also provides information on the efficiency of the mixing process carried out in the mixing apparatus.

The setting of the respective operating parameters, particularly the operating parameters relating to the mixing apparatus and the magnetic separator is substantially carried out in such a way that the content of ore particles and/or magnetic particles in the separator residual flow is reduced and/or minimized.

In general, the method preferably provides that the item of information indicating a measure of the content of ore particles and/or magnetic particles in the respective streams is not used solely as information on the efficiency of the respective processing steps for forming the ore particle-magnetic particle agglomerates or for separating the ore particle-magnetic particle agglomerates from the separator feed flow, but rather that said item of information is used equally as a control signal for setting or adjusting corresponding mixing apparatuses or magnetic separators for separating the ore particle-magnetic particle agglomerates from the separator feed flow.

In a suitable development, it is provided that the item of information is compared with at least one threshold value indicating a minimum or maximum concentration of ore particles in the separator concentrate flow and/or in the separator residual flow, wherein depending on the comparison result, at least one operating parameter of the mixing apparatus and/or of the magnetic separator is set. By setting a threshold value, which expression should also be understood to cover corresponding threshold value ranges, particularly simple and rapid quality monitoring of, in particular, the "load" process can naturally take place and then setting of corresponding operating parameters of the mixing apparatus(es) and/or of the magnetic separator(s) is carried out for the purpose of process optimization.

If, for example, the exceeding of a threshold value, which can naturally also cover corresponding tolerance ranges, of ore particles in the separator concentrate flow or in the separator residual flow is detected, i.e. the content of ore particles in the separator concentrate flow or in the separator residual flow is increased above a pre-defined or pre-definable norm value, this also indicates accordingly, that the proportion of ore particles in the separated ore particle-magnetic particle agglomerates is too low. A corresponding adjustment in particular of at least one operating parameter of the mixing apparatus used for forming the ore particle-magnetic particle agglomerates therefore takes place, so that an intervention in the processing step for forming the ore particle-magnetic particle agglomerates takes place. A similar principle applies if the exceeding of a threshold value of magnetic particles in the separator residual flow is detected.

Any exceeding the content of ore particle-magnetic particle agglomerates in the separator residual flow can optionally be detected, indicating that intervention in the processing step for separating the ore particle-magnetic particle agglomerates from the separator feed flow is required. Therefore, herein at least one operating parameter required for operation of the magnetic separator for separating the ore particle-magnetic particle agglomerates from the separator feed flow is preferably adjusted or optimized.

Preferably, the threshold value is formed taking account of a grinding grade and/or disintegration of the ore particles in the mass flow. Naturally, other parameters, in particular parameters relating to the ore particles, can also be taken into account in the process of forming the threshold value.

It is conceivable that before the actual setting of the at least one operating parameter, an adjustment expected to be associated therewith of the item of information is simulated. A simulation, which typically takes place using suitable simulation algorithms, therefore enables a predictive evaluation of the effects associated with the setting to be carried out on the at least one operating parameter, with regard to the item of information. It is also possibly conceivable to store, in a storage medium, settings made earlier in time of the respective operating parameters or the associated effects on the content of ore particles in the removed ore particle-magnetic particle agglomerates and to take account thereof in the simulation. In this way, an extensively automated dynamic optimization of the content levels of desired particles or unwanted particles in the respective flows can be realized.

Different operating parameters necessary for the operation of corresponding mixing apparatuses and/or magnetic separators are set out below by way of example. The list is not definitive.

As an operating parameter for a suitable mixing apparatus, for example, the concentration of the magnetic particles, in particular the concentration of the magnetic particles relative to the ore particles and/or the concentration and/or the composition of a hydrophobizing agent hydrophobizing the ore particles and/or the magnetic particles and/or the shear rate and/or the mixing duration and/or the composition of the mass flow, in particular of a water content of the mass flow, and/or the flow rate of the mass flow can be used.

As an operating parameter for a suitable magnetic separator, for example, at least one magnetic parameter, in particular, the field strength and/or a field gradient and/or a setting fluidically influencing the mass flow through the magnetic separator, in particular in the form of apertures and/or displacing elements and/or the flow rate of the mass flow through the magnetic separator can be used.

The setting of magnetic parameters is suitable, in particular, where a moving magnetic field separator is used as a magnetic device associated accordingly with the magnetic separator for separating the ore particle-magnetic particle agglomerates from the separator feed flow. This includes the setting of suitable signal exciter forms, signal frequencies, signal phase positions of relative signal forms, such as counter-phase, in phase, speed relative to the flow of the separator feed flow or pulp, and other magnetic parameters affecting the magnetic field.

All the procedures are determined, detected and, in particular, evaluated with suitable computer-based evaluating algorithms via a plurality of decentralized control and/or regulating devices which communicate with one another or one centralized control device and/or regulating device, and are optionally stored in a storage medium.

The determination of the item of information indicating a measure of the content of ore particles or magnetic particles in the respective flows can take place continuously or discontinuously. In the case of a continuous determination of the item of information, said item of information is continuously determined at all times, so that a complete representation of the process management with respect to the yield, particularly of the "load" process is obtained. In the event of discontinuous determination of the item of information, the determination of said item of information is carried out at pre-defined or pre-definable time points, for example, once per minute. Both variations enable an "in situ" or "online" determination of the item of information. Discontinuous determination of the item of information is also understood to be sample taking of ore particle-magnetic particle agglomerates removed from the mass flow, said sample being tested separately from the method, for example in a laboratory, for the composition thereof, i.e. particularly the content of ore particles.

Advantageously, the determination of the item of information takes place continuously and, based on the continuously determined item of information, continuous control and/or regulation of the method is carried out. Thus, in the context of the method, a measure of the content of ore particles or magnetic particles in the respective flows can be determined continuously. The continuous determination of the relevant items of information associated with each flow enables continuous or dynamic regulation or optimization of the process, so that process management of changing process parameters, such as the composition of the mass flow, can be rapidly adjusted, that is, optionally even in real time.

It is also conceivable for at least part of the separator residual flow to be fed again to the mass flow or the separator feed flow. Thus, the ore particles, magnetic particles or ore particle-magnetic particle agglomerates which are contained in the separator residual flow and are still usable are fed again to the mass flow or the separator feed flow. Therefore, ore particles or magnetic particles in the mixing apparatus that are present but unbound and have been fed to the mass flow can be bound to one another again to form ore particle-magnetic particle agglomerates, or ore particle-magnetic particle agglomerates not transferred from the separator feed flow into the separator concentrate flow can be conveyed again through the magnetic separator and possibly separated. The process efficiency can thus be increased because substances which can fundamentally be further used or re-used are not lost.

The separator feed flow can have, for example, a solid substance content of non-magnetic ore particles of below 10%, in particular less than 10%, preferably in the range of 1% to 10% of nickel ore particles. The solid substance content of copper or molybdenum ore particles can be less than 5% and is preferably in the range from 1% to 5%. The content of copper ore particles can be in the range of 0.3% to 2.5%. The content of molybdenum ore particles can be in the range of 0.025% to 0.1%. All content values are purely exemplary. The operating parameter of the mixing apparatus and/or of the magnetic separator are advantageously set such that the content of ore particles and/or magnetic particles in the separator residual flow is reduced, in particular, minimized. This embodiment is advantageously to be used if the extracted ore passes through a first recovery step, frequently known as roughing flotation. At this stage, the maximum mass flow to be processed is present and this can be provided in an order of magnitude in the range of 1000 to 10000 $m^3/h$ because, in pulps, only the ore content present at extraction is contained in the pulp, and thus accordingly a similarly large content of waste rock. It is herein the object to recover as much ore from the pulp as possible. The ore that is not extracted from the pulp in this first extraction step is usually lost and is removed from the plant to a "tailings dam". If this first extraction step is less than optimal with regard to the yield of ore, the economic efficiency of the overall process falls substantially because the yield lacking in this processing step can barely be compensated for in later processing steps.

It is also conceivable that the separator feed flow has a solid substance content of more than 5%, particularly in the range of 5% to 40%, wherein the operating parameters of the mixing apparatus and/or of the magnetic separator are set such that the content of ore particles in the separator concentrate flow is increased, particularly maximized. In this embodiment, the method is used for concentrate processing. A separator feed flow enriched with ore particle-magnetic particle agglomerates is already fed at this stage to the magnetic separator in order to achieve a further increase in the content of ore particle-magnetic particle agglomerates through magnetic removal thereof by the magnetic separator in a separator concentrate flow. In principle, a plurality of these steps is required in order to achieve an ore content in the concentrate flow which is desirable for the further processing.

In addition to the method, the inventors also propose a device for carrying out the above described method. The device comprises at least one mixing apparatus for mixing the mass flow with magnetic particles and forming ore particle-magnetic particle agglomerates, at least one feeding device for feeding the mass flow as a separator feed flow to at least one magnetic separator for separating the ore particle-magnetic particle agglomerates from the mass flow, at least one separating device for separating the ore particles from the separator concentrate flow, at least one detecting device for determining at least one item of information indicating a measure of the content of ore particles and/or magnetic particles in the separator feed flow and/or the separator concentrate flow and/or the separator residual flow, and also comprises at least one control and/or regulating device. The control and/or regulating device comprises at least one machine-readable program, wherein the program is configured depending on the item of information determined for controlling and/or regulating the mixing apparatus and/or the magnetic separator and/or the separating device.

Furthermore, the inventors propose a control and/or regulating device for a device as described above. The control and/or regulating device comprises at least one machine-readable program, wherein the program is configured depending on an item of information indicating a measure of the content of ore particles or magnetic particles in the separator feed flow and/or the separator concentrate flow and/or the separator residual flow for controlling and/or regulating a mixing apparatus and/or the magnetic separator and/or the separating device.

BRIEF DESCRIPTION OF THE DRAWINGS

These and other objects and advantages of the present invention will become more apparent and more readily appreciated from the following description of the preferred embodiments, taken in conjunction with the accompanying drawing of which:

FIG. 1 is a block diagram for one embodiment of the proposed method for obtaining non-magnetic ores from a suspension containing non-magnetic ore particles and magnetic particles.

DETAILED DESCRIPTION OF THE PREFERRED EMBODIMENT

Reference will now be made in detail to the preferred embodiments of the present invention, examples of which are illustrated in the accompanying drawing, wherein like reference numerals refer to like elements throughout.

FIG. 1 shows a block diagram for one embodiment of the proposed method for obtaining non-magnetic ores from a suspension-like mass flow containing non-magnetic ore particles and magnetic particles. The process is preferably a continuous process.

In a first part (box 1), a mass flow in the form of a pulp P and magnetic particles M is fed into a mixing apparatus 14 associated with a device 13 for obtaining non-magnetic ores from a mass flow containing non-magnetic ore particles E, which device 13 can be designated a magnetic flotation cell. The pulp P primarily includes non-magnetic ore particles E, for example, $Cu_2S$ particles and the magnetic particles M are present, for example, in the form of magnetite ($Fe_3O_4$). The magnetic particles M can optionally be already hydrophobized.

A process of mixing the substances fed to the mixing apparatus 14 is carried out while adding further additives, such as in particular, hydrophobizing agents H, for example, xanthate, which enable hydrophobization of the magnetic particles M and/or the ore particles E.

In the second part (box 2), the "load" process takes place, wherein the hydophobized magnetic particles M become deposited on the hydrophobized ore particles E or interact therewith, forming ore particle-magnetic particle agglomerates A. The ore particle-magnetic particle agglomerates A thus obtained in the mass flow comprise at least one hydrophobized magnetic particle M and at least one hydrophobized ore particle E. The magnetic particles M are to be regarded as carrier particles for the ore particles E.

Essential influencing factors for achieving an efficient yield of ore particle-magnetic particle agglomerates A are the mixing duration, the shear forces acting during the mixing process and possibly the degree of grinding, and the grain size or grain size distribution of the ore particles E contained in the mass flow.

In order to carry out the third part (box 4), the mass flow is fed as a separator feed flow (arrow 11) to a magnetic separator 16, in particular by a feeding device 15. In the third part, magnetic separation of the ore particle-magnetic particle agglomerates A from the separator feed flow, i.e. essentially from the gangue G, takes place. For this purpose, the magnetic separator 16, which can also be designated a first separating device, has at least one magnetic device (not shown). The ore particle-magnetic particle agglomerates A which are magnetic due to the magnetic particles M collect in the region of the magnetic device and can thus largely be separated from the gangue G, i.e. carried out of the separator feed flow and transferred to a separator concentrate flow (arrow 12). Non-agglomerated ore particles E and magnetic particles M are carried away (arrow 3) as residues (tailings) in a separator residual flow.

In the subsequent, fourth, part (box 5), the concentrated ore particle-magnetic particle agglomerates A contained in the separator concentrate flow are fed to a second separating device 17 in which the ore particle-magnetic particle agglomerates A are separated into a mixture of ore particles E and magnetic particles M which are present together but separately (in an "unload" process). The separation of the ore particle-magnetic particle agglomerates A can be carried out, for example chemically, in particular, by changing the pH value and/or by adding chemical separating agents T. Also conceivable is the use of ultrasonic waves introduced with an ultrasonic device associated with the second separating device 17.

Altogether, what takes place herein is a mixing process which, by applying shear forces and chemical substances in the form of the separating agents T based, for example, on surfactants, brings about dehyrophobization of the magnetic particles M and the ore particles E, thus separating the ore particle-magnetic particle agglomerates A into the constituents thereof. It is possible that in the second separating device 17, a particular content of gangue G is present which was not able to be properly separated in the previous, third, part.

In the box identified as 6, the "unload" process is largely completed, i.e. a mixture of ore particles E and magnetic particles M which are present together but separately has been created. The magnetic particles M which are present but isolated are magnetically separated via a third separating device 21 comprising a magnetic device, in particular a moving field magnetic separator, from the non-magnetic ore particles E and are transferred to a first mass flow MS1 containing magnetic particles M.

Evidently, the first mass flow MS1 can be fed back so that the magnetic particles M contained therein can be reused at the start of the process (arrow 10). Accordingly, the whole process can be optimized from the economic and ecological standpoints.

The ore particles E are transferred to a second mass flow MS2 containing ore particles E which, in the further process, are dehydrated and/or dried (box 7), so that after water removal or drying, ore particles E which are as dry as possible are produced. The water W is conducted away separately.

Ideally, the first mass flow MS1 contains only magnetic particles M and the second mass flow MS contains only ore particles E. However, in practice, this is difficult to realize and therefore leads to a certain amount of losses of ore particles E bound in the first mass flow MS1 and of magnetic particles M bound in the second mass flow MS2. With regard to the third part of separating the ore particle-magnetic particle agglomerates A from the separator feed flow, it is usually not possible to separate 100% of the ore particle-magnetic particle agglomerates A fed to the first separating device taking the form of the magnetic separator 16, this impossibility being due to statistical reasons and also due to the efficiency level of the magnetic separator 16, which is less than 100%.

However, the loss of ore particles E during the magnetic separation by the magnetic separator 16 using the method can be determined in order to estimate and optionally to optimize the efficiency or the yield of the "load" process and optionally also the overall process.

Accordingly, the method is distinguished in that at least one item of information I indicating a measure of the content of ore particles E or magnetic particles M in the separator feed flow and/or the separator concentrate flow and/or the separator residual flow is determined.

The one item of information I indicating a measure of the content of ore particles E or magnetic particles M, wherein naturally, corresponding items of information I can be determined for the content of both ore particles E and magnetic particles M, can therefore be determined differently from the method described above. Particularly suitable are the processing steps which are at least indirectly linked to the "load" process of mixing the mass flow or the pulp P containing the non-magnetic ore particles E with the magnetic particles M in the mixing apparatus 14 so that the item of information I is determined from the separator feed flow (arrow 11) leaving the mixing apparatus 14 and possibly the feeding device 15. It is also conceivable to determine the item of information I from the separator concentrate flow (arrow 12) containing the ore particle-magnetic particle agglomerates A or from the separator residual flow containing the residues, that is, the tailings (arrow 3). In this way, a measure can be obtained for the yield, in particular, of the "load" process and the process control of the further continuously operating method can be regulated.

The item of information I indicating a measure of the content of ore particles E and/or magnetic particles M is preferably determined for all three flows, that is, the separator feed flow, the separator concentrate flow and the separator residual flow, wherein based on a comparison of the items of information I relating to the respective flows, at least one operating parameter of the mixing apparatus 14 and/or of the magnetic separator 16 is set.

In particular, a comparison of the item of information I relating to the separator feed flow and the item of information I relating to the separator concentrate flow for the relevant content of ore particles E enables a quantitative assessment to be made of the yield of the "load" process. This means that it can be quantitatively determined what content level of ore particles E could be separated from the ore particle-magnetic particle agglomerates A separated from the separator feed flow. In this way, altogether, information of relevance to the process yield of the method can be obtained.

The same applies for a comparison of the items of information I relating to the separator feed flow and the items of information I relating to the separator residual flow concerning the content levels of ore particles or magnetic particles. Also, with the aid of this comparison, altogether qualitative or quantitative information of relevance to the process yield of the method can be obtained.

Determination of the relevant items of information I is preferably carried out continuously by X-ray fluorescence analytical methods, such as X-ray fluorescence spectrometry (XRF) or X-ray diffraction analysis (XRD). Using continuously obtained items of information I, continuous control and/or regulation of the method or individual processing steps or operating or process parameters used in the context of the method are carried out, as illustrated in the following examples.

Using the items of information I determined or the results obtained by comparing particular items of information I, as mentioned above, preferably at least one operating parameter of the mixing apparatus 14 and/or of the magnetic separator 16 is set. Optionally, further devices used in the context of the method, for example, further separating devices 17, 21 or the like or the operating parameters thereof can naturally be set or optimized depending on the item(s) of information I determined.

Examples of operating parameters for the mixing apparatus 14 are the concentration of the magnetic particles M, in particular the concentration of the magnetic particles M relative to the ore particles E and/or the concentration and/or the composition of a hydrophobizing agent H hydrophobizing the ore particles E and/or the magnetic particles M and/or the shear rate and/or the mixing duration and/or the composition of the mass flow, in particular a water content of the mass flow, and/or the flow rate of the mass flow.

Examples of operating parameters for the magnetic separator 16 are at least one magnetic parameter, in particular, the field strength and/or a field gradient and/or a parameter for fluidically influencing the mass flow through the magnetic separator 16, in particular in the form of apertures and/or displacing elements and/or the flow rate of the mass flow through the magnetic separator 16.

In particular, all the control and/or regulating operations performed on the method are carried out in order to enhance the efficiency of the method, that is, for example so that the content of ore particle-magnetic particle agglomerates A in the separator concentrate flow is increased or maximized or the content of ore particles E and/or of magnetic particles M and/or ore particle-magnetic particle agglomerates A in the separator residual flow is reduced or minimized.

Herein, the item of information I can be compared with at least one threshold value indicating a minimum or maximum concentration of ore particles E in the separator concentrate flow and/or in the separator residual flow, wherein depending on the comparison result, at least one operating parameter of the mixing apparatus 14 and/or of the magnetic separator 16 is set. It is therefore possible in this case to provide different threshold values relating to the content of ore particles E, magnetic particles M and/or ore particle-magnetic particle agglomerates A in the different flows. By a comparison of the items of information I determined with the respective threshold values, the process yield can be checked in a simple way. Advantageously, the threshold value(s), which naturally also cover relevant threshold value ranges, is/are formed taking account of a grinding grade and/or disintegration of the ore particles E in the originally used mass flow.

Overall, applying the principle, the method can be made dynamic since, depending on the item of information I, it is always possible to adapt, in an individual manner according to need, particularly in relation to the "load" process, the relevant operating parameters of the mixing apparatus(es) 14 or separating device(s) 16, 17, 21 used in the context of the method, that is, in particular the magnetic separator 16 for separating the ore particle-magnetic particle agglomerates A from the separator feed flow.

Special embodiments of the method provide that before the actual setting of the at least one operating parameter, an adjustment expected to be associated therewith of the item of information I is simulated.

It is also conceivable that the separator residual flow (arrow 3) is fed again to the original mass flow or the separator feed flow after separation of the ore particle-magnetic particle agglomerates A. Ore particles E and/or magnetic particles M contained accordingly in the separator residual flow can optionally be converted into corresponding ore particle-magnetic particle agglomerates A or—with regard to the ore particle-magnetic particle agglomerates A fed back—separated from the separator feed flow. The reusable particles present in the separator residual flow are therefore not lost and this enhances the economic viability of the method.

The separator feed flow can have, for example, a solid substance content of non-magnetic ore particles E of below 10%, in particular less than 10%, preferably in the range of 1% to 10% of nickel ore particles. The solid substance content of copper ore or molybdenum ore particles can be below 5% and is preferably in the range of 1% to 5%. The content of copper ore particles can be in the range of 0.3% to 2.5%. The content of molybdenum ore particles can be in the range of 0.025% to 0.1%. All content values are purely exemplary. The operating parameters of the mixing apparatus 14 and/or of the magnetic separator 16 are advantageously set such that the content of ore particles E and/or magnetic particles M in the separator residual flow is reduced, in particular, minimized.

It is also conceivable that the separator feed flow has a solid substance content of more than 5%, particularly in the range of 5% to 40%, wherein the operating parameters of the mixing apparatus 14 and/or of the magnetic separator 16 are set such that the content of ore particles E in the separator concentrate flow is increased, in particular, maximized.

The boxes 8, 9 shown dashed indicate that a new mixing process (box 8) may possibly be required in order to mix again residues, that is, ore particle-magnetic particle agglomerates A not separated or split following the separation carried out in the fifth part. Herein, the addition of a more concentrated separating medium T may be suitable. Accordingly, a water removal or drying process is performed again (box 9).

The device 13 used to carry out the method comprises, in the minimum configuration thereof, at least one mixing apparatus 14 for mixing the mass flow with possibly previously hydrophobized magnetic particles M, and forming ore particle-magnetic particle agglomerates A, at least one feeding device 15 for feeding the mass flow as a separator feed flow to at least one magnetic separator 16 for separating the ore particle-magnetic particle agglomerates A from the separator feed flow, at least one separating device 17 for separating the ore particles E from the separator concentrate flow, at least one detecting device 18 for determining at least one item of information I indicating a measure of the content of ore particles E or magnetic particles M in the separator feed flow and/or the separator concentrate flow and/or the separator residual flow, and also comprises at least one control and/or regulating device 19. The control and/or regulating device 19 comprises at least one machine-readable program 20, wherein the program 20 is configured depending on the item of information I determined for controlling and/or regulating the mixing apparatus 14 and/or the magnetic separator 16 and/or the separating device(s) 17, 21.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A method for obtaining non-magnetic ores from a suspension mass flow containing non-magnetic ore particles, comprising:

mixing the mass flow with magnetic particles in a mixing apparatus to form ore particle-magnetic particle agglomerates and produce a separator feed flow containing the ore particle-magnetic particle agglomerates;

feeding the separator feed flow to a magnetic separator to separate the ore particle-magnetic particle agglomerates, to produce a separator concentrate flow having an enriched concentration of ore particle-magnetic particle agglomerates and to produce a separator residual flow containing remaining constituents of the separator feed flow;

splitting the ore particles from the ore particle-magnetic particle agglomerates contained in the separator concentrate flow;

determining first and second content information, the first content information specifying a content of ore particles or magnetic particles in a first stream, the second content information specifying a content of ore particles or magnetic particles in a second stream different from the first stream, the first and second streams being selected from the group consisting of the separator feed flow, the separator concentrate flow and the separator residual flow;

comparing the first and second content information to produce a comparison result; and setting an operating parameter of the mixing apparatus or the magnetic separator based on the comparison result.

2. The method as claimed in claim 1, wherein the first content information specifies a content of ore particles and magnetic particles in the first stream, and the second content information specifies a content of ore particles and magnetic particles in the second stream.

3. The method as claimed in claim 1, wherein the first stream is the separator feed flow, and the second stream is the separator residual flow.

4. The method as claimed in claim 1, wherein at least one of the first and second content information is compared a threshold value to produce purity information, the threshold value indicates a minimum concentration of ore particles in the separator concentrate flow or indicates a maximum concentration of ore particles in the separator residual flow, and the purity information is used to control at least one of the mixing apparatus and the magnetic separator.

5. The method as claimed in claim 4, wherein the threshold value is formed taking account of at least one of a grinding grade and a disintegration of the ore particles in the mass flow.

6. The method as claimed in claim 1, wherein, before making an adjustment to the operating parameter, a simulation is performed to estimate how the first and second content information will respond to the adjustment.

7. The method as claimed in claim 1, wherein the operating parameter is set for the mixing apparatus, the mixing apparatus uses a hydrophobizing agent hydrophobize at least one of the ore particles and the magnetic particles, and the operating parameter is at least one parameter selected from the group consisting of a parameter to set a concentration of the magnetic particles relative to the ore particles a concentration of the hydrophobizing agent, a composition of the hydrophobizing agent, a shear rate in the mixing apparatus, a mixing duration in the mixing apparatus, a water content of the mass flow, and a flow rate of the mass flow.

8. The method as claimed in claim 1, wherein the operating parameter is set for the magnetic separator, and the operating parameter is at least one parameter selected from the group consisting of a field strength in the magnetic separator, a field gradient in the magnetic separator, an aperture setting to influence a mass flow rate through the magnetic separator, and a displacement element setting to influence the mass flow rate through the magnetic separator.

9. The method as claimed in claim 1, wherein the first and second content information are determined discontinuously.

10. The method as claimed in claim 1, wherein the first and second content information are determined continuously.

11. The method as claimed in claim 1, wherein the first and second content information are determined continuously to continuously control the operating parameter.

12. The method as claimed in claim 1, wherein the first and second content information are determined with X-ray fluorescence spectrometry or X-ray diffraction analysis.

13. The method as claimed in claim 1, wherein at least part of the separator residual flow is recycled back to the mass flow or recycled back to the separator feed flow.

14. The method as claimed in claim 1, wherein the separator feed flow has a solid substance content of non-magnetic ore particles of below 10%, the separator feed flow contains less than 10% nickel ore particles, the separator feed flow contains 0.3% to 2.5% copper ore particles, the separator feed flow contains 0.025% to 0.1% molybdenum ore particles, and the operating parameter of the mixing apparatus or of the magnetic separator is set to minimize at least one of an ore particle content and a magnetic particle content in the separator residual flow.

15. The method as claimed in claim 1, wherein the separator feed flow has a solid substance content of non-magnetic ores of 5% to 40%, and the operating parameter of the mixing apparatus or of the magnetic separator is set to maximize an ore particle content in the separator concentrate flow.

16. The method as claimed in claim 1, wherein the comparison result is used to set an operating parameter of the mixing apparatus and to set an operating parameter of the magnetic separator.

17. The method as claimed in claim 1, further comprising using the first and second content information to determine a content of unbound ore particles in the separator residual flow.

18. A device to obtain non-magnetic ores from a suspension mass flow containing non-magnetic ore particles, comprising:

a mixing apparatus to mix the mass flow with magnetic particles to form ore particle-magnetic particle agglomerates and produce a separator feed flow containing the ore particle-magnetic particle agglomerates;

a magnetic separator to separate the ore particle-magnetic particle agglomerates from the separator feed flow, to produce a separator concentrate flow having an enriched concentration of ore particle-magnetic particle agglomerates and to produce a separator residual flow containing remaining constituents of the separator feed flow;

a splitter device to split the ore particles from the ore particle-magnetic particle agglomerates contained in the separator concentrate flow;

a detecting device to determine first and second content information, the first content information specifying a content of ore particles or magnetic particles in a first stream, the second content information specifying a content of ore particles or magnetic particles in a second stream different from the first stream, the first and second streams being selected from the group consisting of the separator feed flow, the separator concentrate flow and the separator residual flow; and a control device to:

compare the first and second content information and produce a comparison result; and to set an operating parameter of the mixing apparatus, of the magnetic separator, or of the splitting device, based on the comparison result.

19. A non-transitory computer readable medium storing a program, which when executed by a processor, causes the processor to control a method for obtaining non-magnetic ores from a suspension mass flow containing non-magnetic ore particles, the method comprising:

mixing the mass flow with magnetic particles in a mixing apparatus to form ore particle-magnetic particle agglomerates and produce a separator feed flow containing the ore particle-magnetic particle agglomerates;

feeding the separator feed flow to a magnetic separator to separate the ore particle-magnetic particle agglomerates, to produce a separator concentrate flow having an enriched concentration of ore particle-magnetic particle agglomerates and to produce a separator residual flow containing remaining constituents of the separator feed flow;

splitting the ore particles from the ore particle-magnetic particle agglomerates contained in the separator concentrate flow;

determining first and second content information, the first content information specifying a content of ore particles or magnetic particles in a first stream, the second content information specifying a content of ore particles or magnetic particles in a second stream different from the first stream, the first and second streams being selected from the group consisting of the separator feed flow, the separator concentrate flow and the separator residual flow;

comparing the first and second content information to produce a comparison result; and setting an operating parameter of the mixing apparatus or the magnetic separator based on the comparison result.

* * * * *

UNITED STATES PATENT AND TRADEMARK OFFICE

CERTIFICATE OF CORRECTION

PATENT NO. : 8,991,615 B2
APPLICATION NO. : 14/128749
DATED : March 31, 2015
INVENTOR(S) : Michael Diez et al.

It is certified that error appears in the above-identified patent and that said Letters Patent is hereby corrected as shown below:

In the Claims

Column 14, Line 35, In Claim 4, delete “compared a” and insert -- compared with --, therefor.

Signed and Sealed this
Twenty-third Day of June, 2015

Michelle K. Lee

Michelle K. Lee
*Director of the United States Patent and Trademark Office*